United States Patent [19]

Ito

[11] 4,393,671

[45] Jul. 19, 1983

[54] APPARATUS FOR DYEING FIBER BY UTILIZING MICROWAVES

[76] Inventor: Hajime Ito, 2-32, Kamiotai, Nishi-Ku, Nagoya City, Aichi Prefecture, Japan

[21] Appl. No.: 225,437

[22] Filed: Jan. 15, 1981

[30] Foreign Application Priority Data

Jan. 19, 1980 [JP] Japan ..... 55-4687
Aug. 25, 1980 [JP] Japan ..... 55-117229

[51] Int. Cl.[3] ..... D06B 3/02

[52] U.S. Cl. ..... 68/5 C; 8/444; 34/1; 68/13 R; 68/171; 68/210; 219/10.55 A; 219/10.55 F

[58] Field of Search ..... 68/5 C, 13 R, 171, 210; 8/444; 34/1; 219/10.55 R, 10.55 A, 10.55 F

[56] References Cited

U.S. PATENT DOCUMENTS

| | | | |
|---|---|---|---|
| 3,276,138 | 10/1966 | Fritz | 34/1 |
| 3,462,575 | 8/1969 | Holaday | 219/10.55 R |
| 3,596,481 | 8/1971 | Wilcox | 68/210 X |
| 3,932,129 | 1/1975 | Porter | 8/444 |
| 4,274,209 | 6/1981 | Kawaguchi | 68/5 C X |
| 4,289,792 | 9/1981 | Smith | 219/10.55 R X |
| 4,323,361 | 4/1982 | Graham et al. | 8/444 |

FOREIGN PATENT DOCUMENTS 40-28920 12/1965 Japan ..... 68/5 C

*Primary Examiner*—Philip R. Coe
*Attorney, Agent, or Firm*—Fred Philpitt

[57] ABSTRACT

The apparatus comprises a vessel to hold fiber to be dyed, the vessel being formed of a gas tight pressure resisting sealed construction and having a lid member to seal the vessel, the lid member being provided with a pressure control valve to control the internal pressure of the vessel, and the vessel being formed in cylindrical shape and being provided with a ring body integrally on its outer periphery; a flatcar for mounting the vessel which includes a pair of rotary shafts on an underframe, and the rotary shafts being rotatably connected to an output shaft of a geared motor by means of a chain, and the rotary shaft having a slip stop ring to position the rotary ring body of the vessel; and a microwave oscillating device having a radiation chamber connected to a microwave oscillator by means of a waveguide, and the internal pressure of the vessel being set at pressure above one atmosphere of pressure, and the microwaves are used to generate heat and the fiber is dyed by a boiling phenomenon at a boiling temperature above 100° C.

3 Claims, 10 Drawing Figures

APPARATUS FOR DYEING FIBER BY UTILIZING MICROWAVES

BACKGROUND OF THE INVENTION

This invention relates to apparatus for dyeing fiber which performs a fixing treatment of fiber such as yarn, cloth, raw stock or the like.

Fixing (dyeing) the dye on the fiber by utilizing heating action caused by the microwave radiation has heretofore been known to the art. A method of using the microwaves for fixing the dye is an extremely hopeful technique from the viewpoint of energy saving since the dyeing treatment can be performed with a very small thermal energy consumption as compared with other methods (for instance, a method by Overmyer dyeing machine). However, the dyeing of the fiber by the microwaves has heretofore been experimentally put to work, and the result of such experiment shows the drawback that the degree of fixing of the dye results in so called "uneven dyeing", and therefore such dyeing is not industrially put to work even at present.

This invention has solved the foregoing drawback.

SUMMARY OF THE INVENTION

An object of this invention is to provide apparatus for dyeing fiber by microwave radiation which makes it possible to irradiate the microwaves uniformly over the entire fiber to be dyed thus promoting uniform heating of the entire fiber to be dyed, and as the result, "uneven dyeing" can be eliminated, and the dye is unformly fixed on the fiber to be dyed.

Another object of this invention is to provide a vessel of gas tight pressure resisting sealed structure that holds the fiber to be dyed, and in the gas tight chamber, high temperatures can be obtained with a small energy by promoting the elevation of atmospheric pressure through the heating of the inside of the vessel.

A further object of this invention is to provide a vessel of gas tight pressure resisting sealed structure whose entire body is formed with fiber reinforced plastics (FPR) to facilitate easy transmission of the microwaves.

A still further object of this invention is to provide a pressure resisting sealed vessel which is provided with a pressure control valve to hold the inside of the vessel at a fixed pressure whereby the inside of the pressure resisting sealed vessel is set and kept at a desired pressure below atmospheric pressure.

A more specific object of this invention is to provide a pressure resisting sealed vessel provided with a check valve to blow compressed air or steam, and in order to compensate for insufficient elevation of the pressure inside of the vessel resulting from the case where the amount of the fiber to be dyed accommodated in the vessel is small, the compressed air or steam is blown into the vessel by means of the check valve to increase the pressure, and the desired pressure above atmospheric pressure is easily set and kept inside of the vessel.

A particular object of this invention is to provide a microwave oscillating device to irradiate the microwaves to the vessel holding the fiber to be dyed.

Another and more particular object of this invention is to provide a flatcar to rotate the pressure resisting sealed vessel disposed in the zone of the microwaves irradiated by the microwave oscillating device to facilitate an ideal and uniform heating by promoting stirring action in the fiber to be dyed in the pressure resisting sealed vessel according to the rotating movement of the pressure resisting sealed vessel.

An additional object of this invention is to obtain a uniform fixing of the dye by a uniform heating in such manners that the pressure inside of the pressure resisting sealed vessel is set to a desired pressure above atmospheric pressure and the generation of bubbles in the fiber structures accompanied by a boiling phenomenon of the dyeing liquid causes the much deeper permeation of the microwaves and simultaneously the steam generated at the time of boiling of the dyeing liquid is saturated inside of the pressure resisting sealed vessel which promotes the fixing of the dye through the permeation of steam component and component of the dye deep into the fiber, and as the result, the partial difference of temperature elevation rate which gives a ground to "uneven dyeing" can be eliminated by utilizing the principle of boiling.

A further object of this invention is to make possible the dyeing of the fiber with a minimum quantity of dyeing liquid by setting a boiling temperature of the dyeing liquid at temperatures above 100° C. and suppressing the vaporization of the dyeing liquid during the time of reaching the boiling temperature.

DETAILED DESCRIPTION OF THE INVENTION

A vessel shown by letter C is a vessel of gas tight pressure resisting sealed structure to hold fiber F to be dyed such as yarn, cloth or raw stock, which is wetted with the dyeing liquid, and this vessel C is mounted on a flatcar M and is disposed in a zone of the microwaves from a microwave oscillating device W, and the irradiation occurs while the vessel is being rotated on the flatcar M to boil the dyeing liquid at temperatures above 100° C. thereby to dye the fiber F uniformly.

Figure 2:
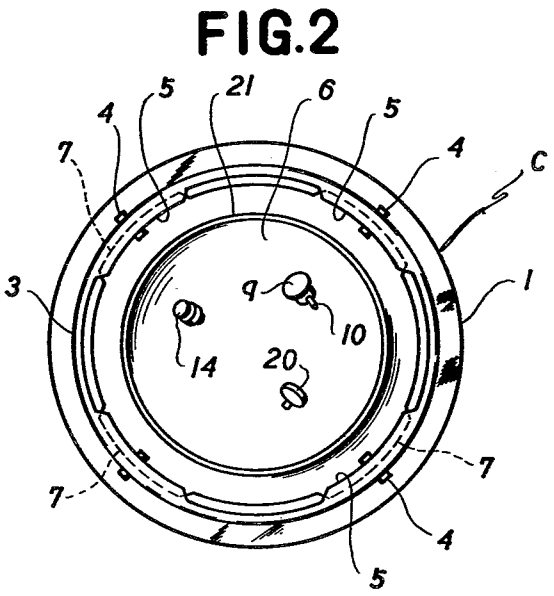
FIG. 2 is a plan of the pressure resisting sealed vessel.
Figure 1:
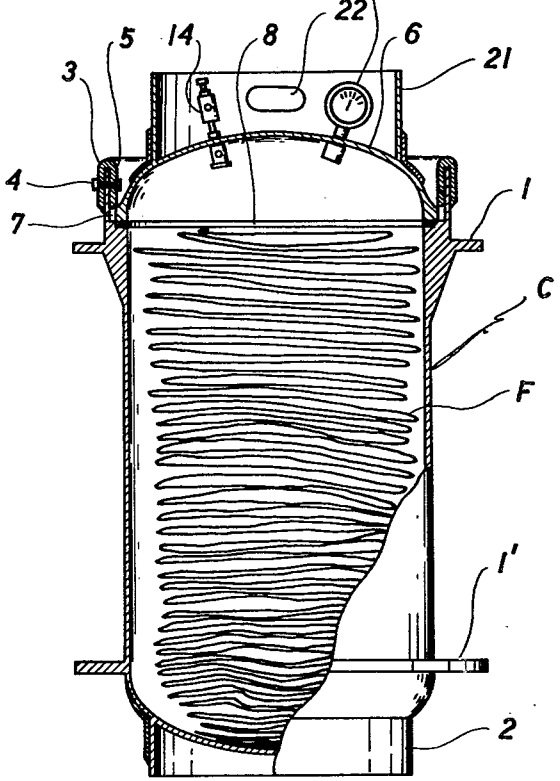
FIG. 1 is an elevation showing a partial cross section of a pressure resisting sealed vessel.
Figure 4:
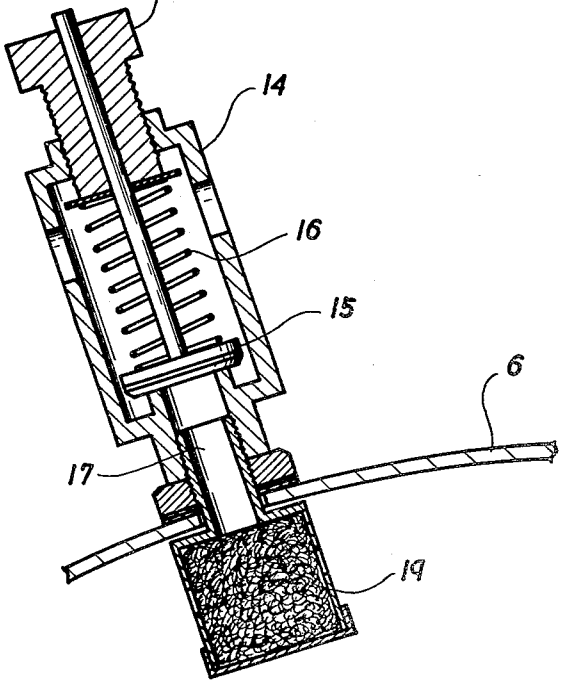
FIG. 4 is a vertical cross section of a pressure control valve.
Figure 3:
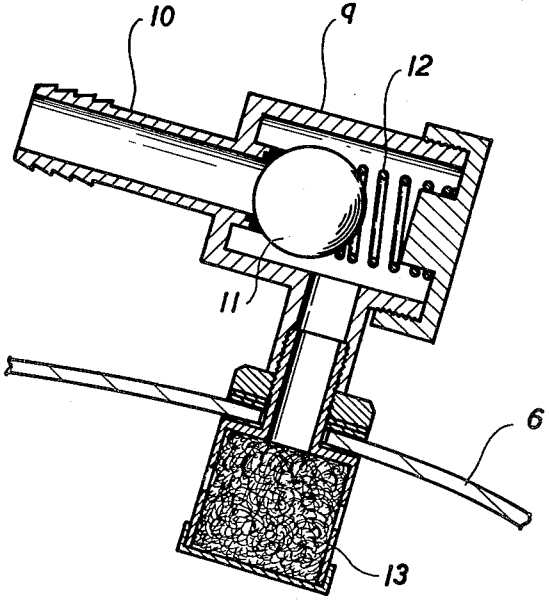
FIG. 3 is a vertical cross section of a check valve.

The entire body of the pressure resisting sealed vessel C is molded from a glass fiber reinforced plastics (FPR) to facilitate the transmission of the microwaves easily into the inside of the vessel C, and the entire body of this vessel C is formed in a cylindrical shape, and flange portions 1, 1' are integrally and projectedly formed on the other periphery, and a cylindrical end portion 2 to set the vessel C in an upright state is provided on the vessel C, and a ring body 3 is fixed to the outer periphery of the opening edge of the upper part by means of a set screw 4, and the ring body 3 is folded in an inverted U-shape at the upper end of the opening edge of the vessel C and engaging portions 5, 5 . . . projecting partially into the inside of the vessel C are spaced apart at a fixed interval. Reference numeral 6 denotes a lid member of the pressure resisting sealed vessel C, and the lid member 6 is provided with projections 7, 7 . . . on the peripheral edge portion, and in case the projections 7, 7 . . . are engaged with the lower sides of the engaging portions 5, 5 . . . by turning the lid member 6 through the gaps of the engaging portions 5, 5 . . . of the vessel C, and the lid member 6 is placed over the opening edge of the pressure resisting sealed vessel C gas tightly by means of a gasket 8. Reference numeral 9 denotes a check valve mounted on the lid member 6 to blow the compressed air or the steam into the pressure resisting sealed vessel C. As shown in FIG. 3, the check valve 9 resiliently urges a ball valve 11 against a blowing opening 10 by means of a coil spring 12, and is provided with a ventilation strainer 13 that holds a sponge. Reference numeral 14 denotes a pressure control valve mounted on the lid member 6 and, as shown in FIG. 4, a valve body 15 is pressed into an opening end continuous with a ventilation tube 17 by means of a coil spring 16, and a compression quantity of the valve body 15 can be adjusted by a thread amount of an adjusting screw 18, and is formed with a ventilation strainer 19. Reference numeral 20 denotes a pressure gauge mounted similarly on the lid member 6. Reference numeral 21 denotes a cylindrical end portion provided integrally on the outer surface of the lid member 6 and is provided with a handle hole 22 and the check valve 9, pressure control valve 13 and pressure gauge 20 are surrounded by the cylindrical end portion 21.

However, the check valve 9 is not necessarily provided on the vessel C. Namely, in case an amount of the fiber F to be dyed which is held in the vessel C is too small relative to a volume of the vessel C, the quantity of the dyeing liquid that impregnates the fiber F to be dyed becomes small, and consequently, the desired boiling temperature cannot be obtained on account of the small quantity of the evaporated dyeing liquid. In such a case, the compressed air or the steam is blown into the vessel C to increase the pressure and as the result, the desired dyeing temperature can be easily obtained. Accordingly, in the normal case, when a sufficient amount of the fiber to be dyed is placed in the vessel C, there is almost no need of blowing the compressed air or the steam into the vessel C.

Figure 5:
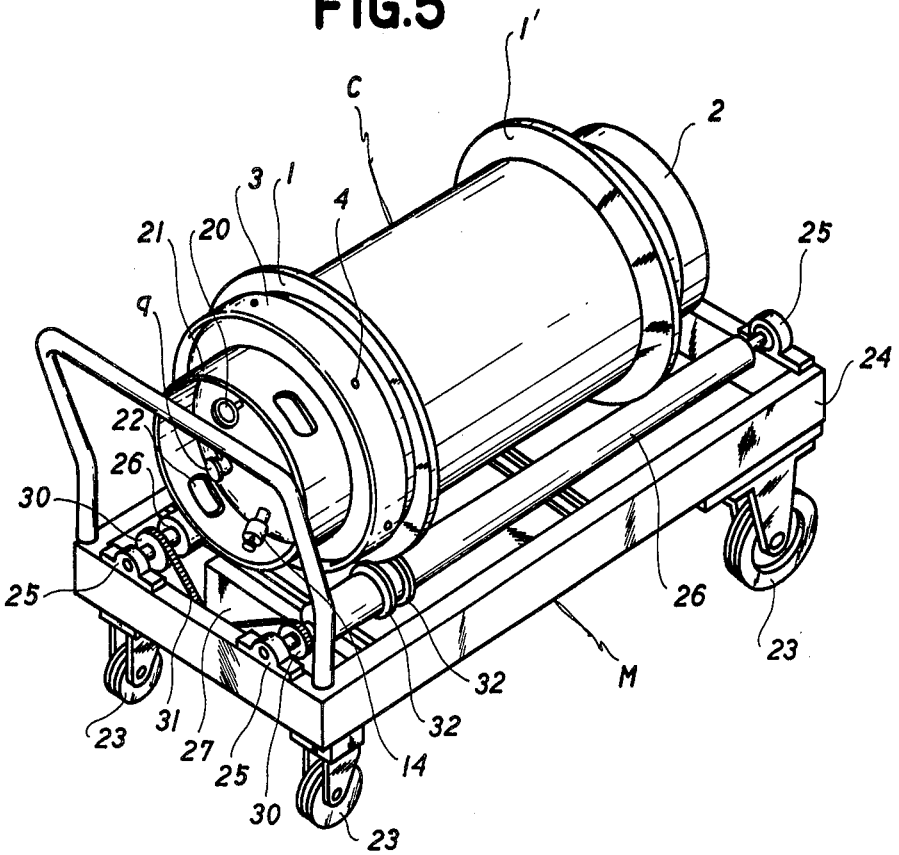
FIG. 5 is a perspective view of the pressure resisting sealed vessel disposed sideways on a flatcar.
Figure 6:
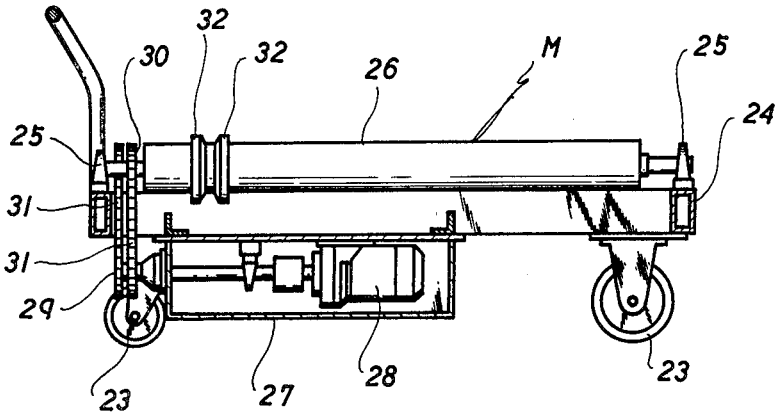
FIG. 6 is a side view of the flatcar.

FIG. 5 shows a condition where the pressure resisting sealed vessel C is mounted on the flatcar M sideways. Both end portions of this flatcar M, as shown in FIG. 6, are rotatably supported on the underframe 24 provided with wheels 23, 23 . . . by means of bearings 25, and a pair of rotary shafts 26, 26 are provided in parallel, and a geared motor 28 is provided in a radio wave shield box 27 disposed in the lower part of the underframe 24, and a sprocket 29 fixed to an output shaft of the geared motor 28 and sprockets 30, 30 fixed to the rotary shafts 26, 26 are connected by means of an endless chain 31. Reference numeral 32, 32 denote slip stop rings fixed to the outer peripheries of the rotary shafts 26, 26 and position one flange portion 1 of the pressure resisting sealed vessel C between the slip stop ring 32, 32 to dispose the pressure resisting sealed vessel C sideways on both the rotary shafts 26, 26. The rotary shafts 26, 26 are rotated in the same direction by the operation of the geared motor 28 by means of the endless chain 31 whereby the pressure resisting sealed vessel C is rotated.

Figure 7:
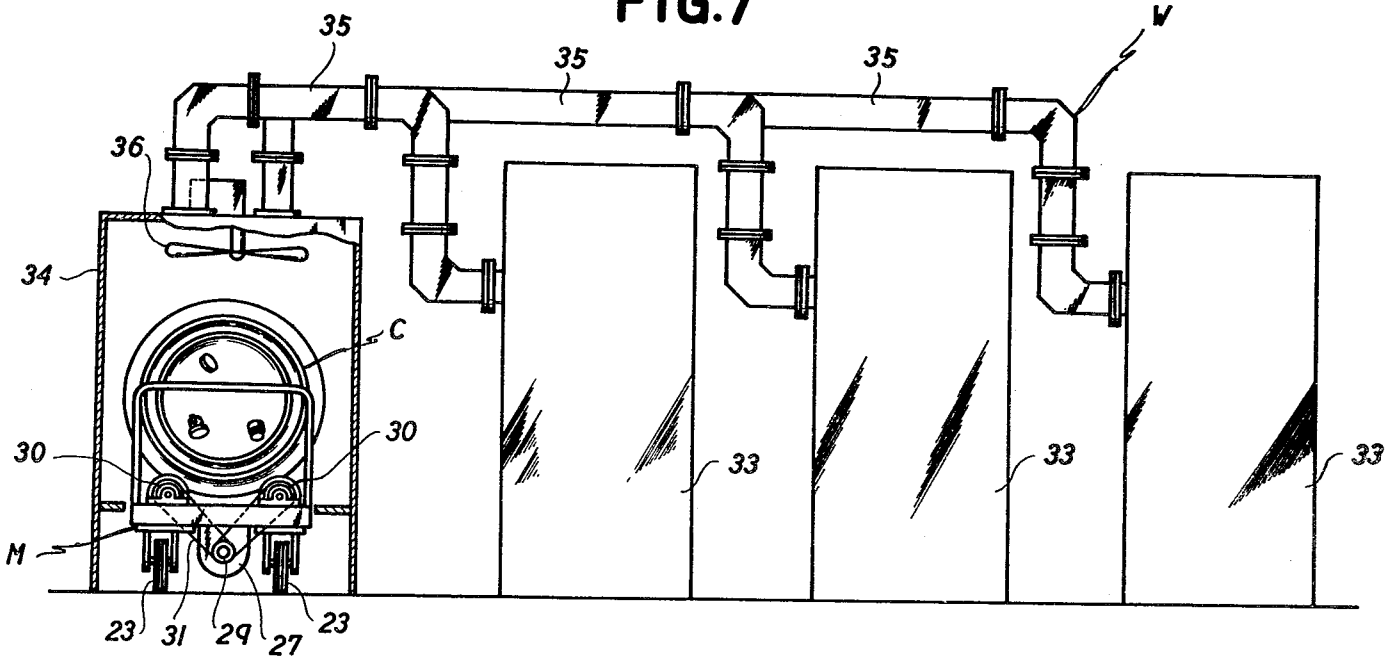
FIG. 7 is a side view showing a partial cross section of an entire body of a microwave oscillating device.

FIG. 7 shows an entire microwave oscillating device W, and numerals 33, 33, 33 denote microwave oscillators whose output number is 10 KW and oscillates the microwaves whose frequency ranges from several mega Hz to 2500 mega Hz, and numeral 34 denotes a radiation chamber, and the radiation chamber and each oscillator are connected by means of a waveguide 35, and the microwaves generated by each oscillator are collected in the radiation chamber 34 by means of each waveguide 35. Reference numeral 36 denotes an impeller provided on its ceiling portion to disperse the microwaves of the radiation chamber 34.

The fiber F to be dyed is accommodated in the pressure resisting sealed vessel C and the pressure inside of the vessel C is set by the control valve 14 to hold the pressure at the desired pressure above one atmosphere of pressure. In case the amount of the fiber F to be dyed which is accommodated in the vessel C is too small relative to the volume of the vessel C, the compressed air or the steam is blown by the check valve 9 to elevate the internal pressure of the vessel C to the atmospheric pressure above one atmosphere of pressure. The vessel C is mounted on the flatcar M sideways, and is introduced into the radiation chamber 34 and subjected to irradiation with microwaves while the vessel C is being rotated on the flatcar M. For this reason, the microwaves radiate upon the fiber F to be dyed in the pressure resisting sealed chamber C and the dyeing liquid is heated and the temperature in the vessel C is elevated. In the case there is a portion of the fiber F to be dyed whose temperature rise is fast, the heat of evaporation is taken away by the vaporization of the dyeing liquid and the steam is shifted in the inside of the pressure resisting sealed vessel C which results in the heating of the portion whose temperature rise is slow, whereby the entire fiber F to be dyed is uniformly heated. Also, when the pressure resisting sealed vessel C is rotated during radiation with the microwaves, the microwaves can be uniformly applied, and the stirring action of the fiber F to be dyed in the pressure resisting vessel C accompanied by the rotary movement is applied to make uniform heating possible. The pressure in the pressure resisting sealed vessel C is further elevated according to the temperature rise but when it reaches the fixed atmospheric pressure, the valve body 15 of the pressure control valve 14 becomes movable by overcoming the resilience of the coil spring 16, and as the result, a steam is discharged therefrom and no further pressure rise occurs. When the atmospheric pressure of the dyeing liquid becomes equal to the atmospheric pressure in the pressure resisting sealed vessel C, the bubbles of the steam from the inside of the dyeing liquid occur, whereby a so called; boiling phenomenon; occurs. The generation of the bubbles in the fiber F can permeate more deeply into the fiber structure. Also, when the steam generated at the time is saturated in the pressure resisting sealed vessel C, the steam particles and the particles of the dye permeate deeply into the fiber to promote the fixing. The boiling temperature at the time is controlled at the desired temperature above 100° C.

As described according to the foregoing, in this invention, the setting of the atmospheric pressure in the pressure resisting sealed vessel C above one atmosphere of pressure can elevate the boiling temperature. Namely, in the case where the dyeing liquid is boiled at a relatively low temperature and at a pressure below one atmosphere, the dyeing liquid is caused to vaporize while the temperature remains low so that the dried condition is attained in the pressure resisting sealed vessel C before it rises to the temperature necessary for the dyeing. As the result, in this invention, the boiling temperature can be set at a higher boiling temperature so that the vaporization of the dyeing liquid can be suppressed until reaching the boiling temperature whereby the dyeing becomes possible with a minimum quantity of the dyeing liquid.

Also, where the fiber F to be dyed is accommodated in the pressure resisting sealed vessel C, if the fiber F to be dyed is placed in a cloth bag (not shown in the drawing) and the cloth bag is accommodated in the vessel C, the cloth bag is interposed between the inner wall surface in the vessel C and the fiber F to be dyed to effect a heat insulating action, which prevents the wall of the vessel C from absorption of the generated heat of the fiber F to be dyed to a possible extent. Because of this arrangement, the fiber F to be dyed comes to contact with the surface of the inner wall of the vessel C to obstruct the temperature elevation, and the resulting possible uneven heating can be easily eliminated by interposing the insulating material such as the cloth bag.

After radiation with microwaves, the vessel C is left out in its heat insulated condition without opening the lid member 5 for a fixed time.

By the way, in general, since dyeing is impossible in the dried condition, and even in the foregoing case, of course, the fiber F to be dyed must be wetted beforehand by a proper quantity of the dyeing liquid to keep the dyeing liquid in the quantity required for saturation with the dyeing liquid steam, but as described above, with the present the boiling temperature can be elevated by the rise of the atmospheric pressure in the pressure resisting sealed vessel C so that the dyeing liquid is not boiled until reaching the temperature necessary for the dyeing, and accordingly, the vaporization in the meantime can be kept small, which facilitates the dyeing by the dyeing liquid of a minimum requirement.

Figure 8:
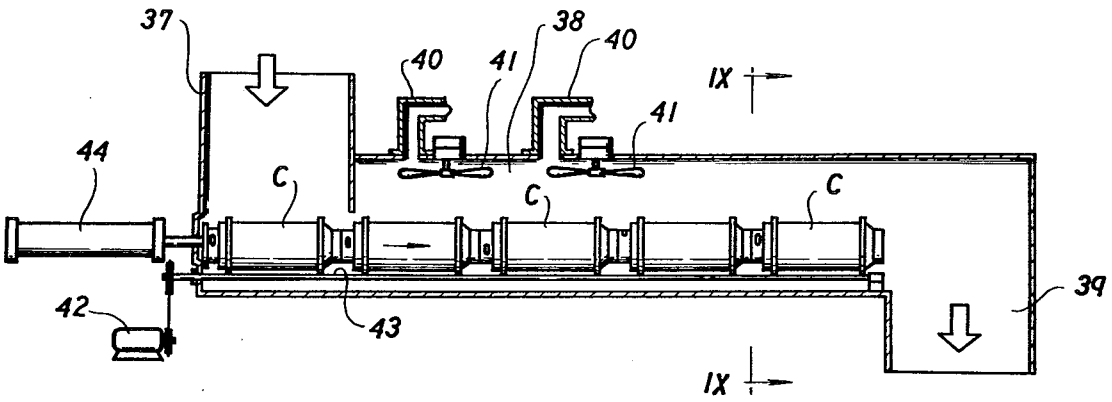
FIG. 8 is a vertical cross section showing an example of a continuous type treating device.
Figure 9:
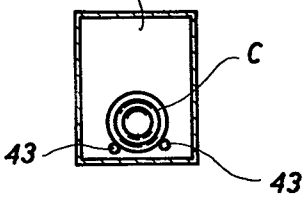
FIG. 9 is a cross section taken along a line IX—IX of FIG. 8.

FIGS. 8 and 9 show an example of the case where the radiation of the microwaves is carried out continuously in a plurality of the pressure resisting sealed vessels C, and numeral 37 denotes a loading inlet, and numeral 38 denotes a radiation zone, and numeral 39 denotes an extraction outlet, and numeral 40 denotes a waveguide provided in the radiation zone, and numeral 41 denotes an impeller. The pressure resisting sealed vessels C which are loaded through the loading inlet 37 are mounted sideways on two pieces of parallel round bar-like rails 43 which rotate by the power of a motor 42, and are pushed forward in the direction of an arrow mark on the rails 43 by the advancing and retreating movements of a piston rod of a cylinder 44, and the microwaves are irradiated while the vessel C are rotated and are extracted to the extraction outlet 39. The ideal uniform heating of the fiber F to be dyed in the pressure resisting sealed vessels C by the radiation of the microwaves is taken place similar to the case of FIG. 7 as described in the foregoing.

Figure 10:
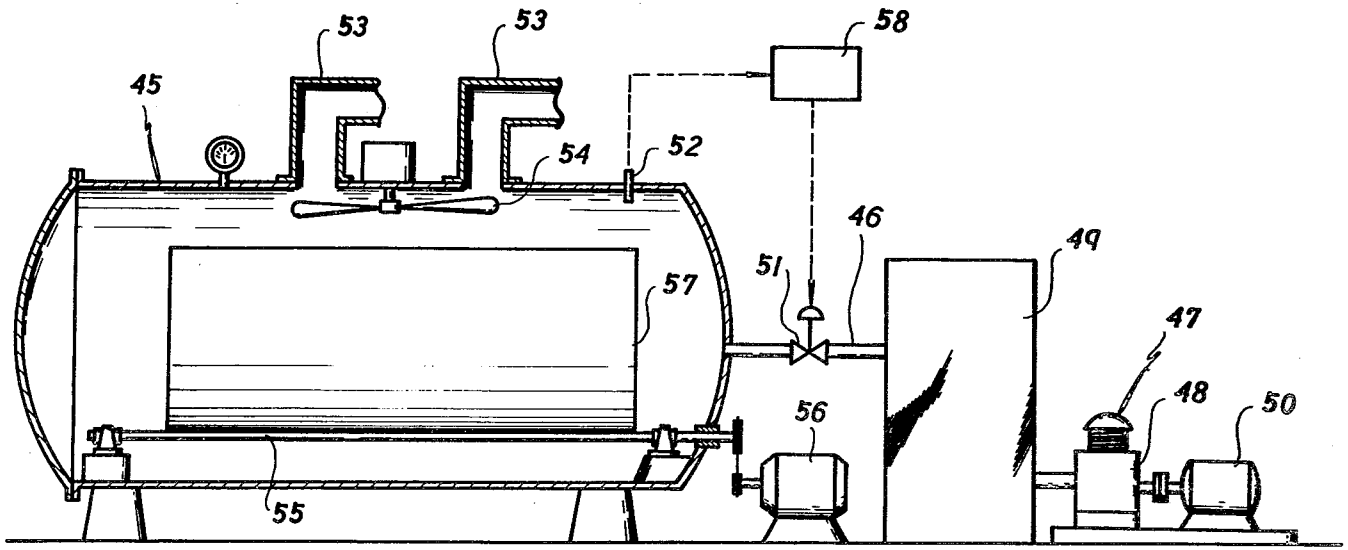
FIG. 10 is a vertical cross section of a microwave radiation chamber.

FIG. 10 shows an example of another embodiment of this invention. In this invention, a microwave radiation chamber 45 is made as a gas tight pressure resisting sealed structure, and an intensifier 47 is connected to the microwave radiation chamber 45 by means of a communicating tube 46. The intensifier 47 is constructed in such a way that in case a compressor 48 is operated by the drive of a motor 53, the inside of a tank 49 is intensified at the predetermined atmospheric pressure. Reference numeral 51 denotes an electromagnetic valve interposed in the communicating tube 46, and numeral 52 denotes an automatic measuring unit to detect the atmospheric pressure or the temperature in the microwave radiation chamber 45, and a detection signal of the measuring unit 52 is inputted to a ratio setting unit 58, and a comparison of the previously set atmospheric pressure or the temperature therein and the detected value of the measuring unit 52 is performed, and an instruction is imparted to the electromagnetic valve 51 to obtain the predetermined atmospheric pressure or the temperature in the microwave radiation chamber 45 so that the atmospheric pressure in the microwave radiation chamber 45 can be controlled. Reference numerals 53, 54 denote a waveguide, impeller similar to the foregoing description, and numeral 55 denotes two pieces of parallel rotary shafts disposed on the floor portion of the microwave radiation chamber 45 and the vessel 57 mounted sideways on the rotary shafts is rotated by the operation of a motor 56. The fiber F to be dyed which is wetted by the dyeing liquid is accommodated in the vessel 57, but the vessel 57 is of non-sealed condition so that the atmospheric pressure in the vessel 57 becomes equal to the atmospheric pressure in the microwave radiation chamber 45. By the way, the fact that the vessel 57 is made of the microwave transmitting material remains the same as described in the foregoing. In this case, since the entirety of the inside of the microwave radiation chamber 45 is controlled at the predetermined atmospheric pressure by means of the electromagnetic valve 51, it is feasible to boil the dyeing liquid at the desired temperature, and the fiber to be dyed in the vessel 57 can be uniformly heated similar to the foregoing description.

Also, the fiber to be dyed in accordance with this invention includes natural fiber such as cotton, wool or the like, and semisynthetic fiber such as rayon, acetate or the like as well as various kinds of synthetic fibers.

In case various kinds of the foregoing fibers are dyed, the setting of atmospheric pressure, dyeing temperature or boiling temperature, microwave radiation time and keeping time (time to heat insulation in sealed condition after the microwave radiation) are shown in the following table.

TABLE

| Name of Fiber | Dyeing Temperature (boiling temperature) | Atmospheric Pressure (gauge pressure) | Radiation Time of Microwaves | Keeping Time |
|---|---|---|---|---|
| Tetoron | 138° C. | 3.0 kg/cm$^2$ | 5-15 minutes | 5-15 minutes |
| Wool | 105° C. | 0.5 kg/cm$^2$ | 5-10 minutes | 5-15 minutes |
| Rayon | 105° C. | 0.5 kg/cm$^2$ | 5-10 minutes | 5-15 minutes |
| Cotton | 105° C. | 0.5 kg/cm$^2$ | 5-10 minutes | 5-15 minutes |
| Nylon | 105° C. | 0.5 kg/cm$^2$ | 5-10 minutes | 5-15 minutes |
| Acryl | 105° C. | 0.5 kg/cm$^2$ | 5-10 minutes | 5-15 minutes |

Accordingly, in this invention, the microwaves are irradiated to the fiber to be dyed by setting the atmospheric pressure above one atmospheric pressure in the microwave radiation chamber of the pressure resisting sealed vessel or the microwave radiation chamber of the pressure resisting sealed construction of a fixed volume so that the fiber to be dyed can be ideally and uniformly heated by the boiling of high temperature above 100° C.

and the fixing of the dye can be made uniform and the uneven dyeing can be eliminated. Moreover, since the microwave energy can heat the fiber to be dyed uniformly penetrating through the deep portion, this system being entirely different from the conventional external heating system and the fixing treatment can be performed rapidly in a short time, and therefore a high treating performance can be provided. For this reason, there are various kinds of useful effects such as that the consumption of the thermal energy is small and greatly contributes to the reduction of fabricating cost. Furthermore, depending on the degree of intensification, the boiling can be effected at the desired temperature, and consequently ideal dyeing becomes possible which matches characteristics of the dye and the fiber to be dyed.

What is claimed is:

1. A fiber dyeing apparatus which comprises (a) a vessel which is adapted to hold a quantity of fiber to be dyed, said vessel being formed of a material capable of transmitting microwaves, said vessel being formed of a gas tight pressure resisting sealed construction, said vessel being provided with a lid member to seal the vessel, said lid member being provided with a control valve to control the internal pressure of the vessel, (b) a flat car located underneath said vessel so that the vessel can be moved from one place to another, said vessel being supported on said flatcar by rotary shafts that are connected with means to rotate them and thereby move the vessel rotatively, (c) a radiation chamber extending around said vessel and said flatcar, (d) a microwave generator, and (e) a microwave guide for conducting microwaves from said microwave generator to said radiation chamber so that the vessels containing fiber that are located in said radiation chamber can be irradiated.

2. A fiber dyeing apparatus according to claim 1 wherein the exterior of said vessel is provided with an outwardly extending annular flange member that is adapted to rest on said rotary shafts intermediate slip stop rings located on the periphery of at least one of said rotary shafts.

3. A fiber dyeing apparatus according to claim 1 wherein said lid member is provided with a check valve to allow blowing of steam in the vessel and a control valve to control the internal pressure.

* * * * *